US008434654B2

(12) United States Patent
Smith et al.

(10) Patent No.: US 8,434,654 B2
(45) Date of Patent: May 7, 2013

(54) BOAT AND GARAGE HITCHING DEVICE AND CARRYING/STORING SYSTEM

(76) Inventors: Ronald D. Smith, Anderson, IN (US); Mark A. Noffsinger, Mattawan, MI (US); Robert J. Cline, Milford, IN (US)

( * ) Notice: Subject to any disclaimer, the term of this patent is extended or adjusted under 35 U.S.C. 154(b) by 0 days.

(21) Appl. No.: 11/818,815

(22) Filed: Jun. 15, 2007

(65) Prior Publication Data

US 2008/0011218 A1 Jan. 17, 2008

Related U.S. Application Data

(60) Provisional application No. 60/814,173, filed on Jun. 16, 2006.

(51) Int. Cl.
*B60R 9/06* (2006.01)

(52) U.S. Cl.
USPC ..... 224/406; 224/497; 224/502; 224/519; 280/491.1

(58) Field of Classification Search ..... 224/406, 224/521, 502, 495, 497, 504, 505, 506, 519; 280/461.1, 491.1, 491.3, 491.4, 491.5, 495, 280/769; 114/364, 249; 211/87.01, 100; 414/543
See application file for complete search history.

(56) References Cited

U.S. PATENT DOCUMENTS 3,614,136 A * 10/1971 Dent ..... 280/500
3,805,722 A 4/1974 Melchert, Jr. et al.
3,925,836 A 12/1975 Simmonds
3,978,989 A * 9/1976 Avila, Jr. ..... 212/176
4,280,713 A * 7/1981 Bruhn ..... 280/416.1
4,333,665 A * 6/1982 Haddock ..... 280/408
4,729,535 A * 3/1988 Frazier et al. ..... 248/230.4
5,439,152 A 8/1995 Campbell
5,454,342 A 10/1995 Colquett et al.
5,673,507 A 10/1997 Stokes, Jr.
5,893,575 A 4/1999 Larkin
5,901,890 A * 5/1999 Stokes ..... 224/406
5,927,226 A * 7/1999 Patterson ..... 114/249
5,950,617 A * 9/1999 Lorenz ..... 126/276
6,129,371 A * 10/2000 Powell ..... 280/461.1
6,460,908 B1 * 10/2002 Green ..... 293/117
6,554,170 B1 4/2003 Correll et al.
6,701,913 B1 * 3/2004 LeDuc et al. ..... 126/276
6,846,000 B2 1/2005 Grinde et al.
6,935,650 B2 8/2005 Grinde et al.
7,143,914 B2 * 12/2006 McManus ..... 224/519
7,255,362 B2 * 8/2007 Smith ..... 280/490.1

* cited by examiner

*Primary Examiner* — Nathan J Newhouse
*Assistant Examiner* — Scott McNurlen
(74) *Attorney, Agent, or Firm* — John D. Ritchison; Ritchison Law Offices, PC

(57) ABSTRACT

A BOAT HITCHING DEVICE AND CARRYING SYSTEM used for a carrying device for boats. This device is used in and around diving deck of the boat. The device is comprised essentially of two main parts: 1. A case which features a way to fasten the device to the boat; a way to rotate a receptor from a stored position and then securely retain the receptor in an essentially horizontal "use" position; a manner to pivot and securely retain the receptor in the use position; and features to provide a safe, flat deck when the device is in storage and 2. a receptor with a hub to pivotally yet securely connect to the case; a receiver structure to receive the various carrying accessories; and a way to securely retain the accessories. These devices are designed for Original Equipment or After Market offerings.

2 Claims, 10 Drawing Sheets

33

31

35

34

32

36

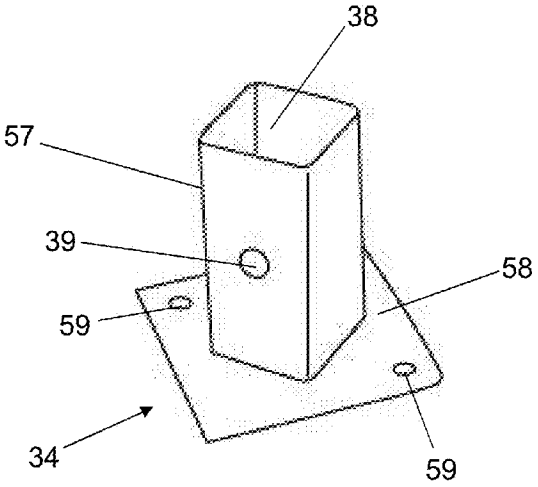
Fig. 2 B
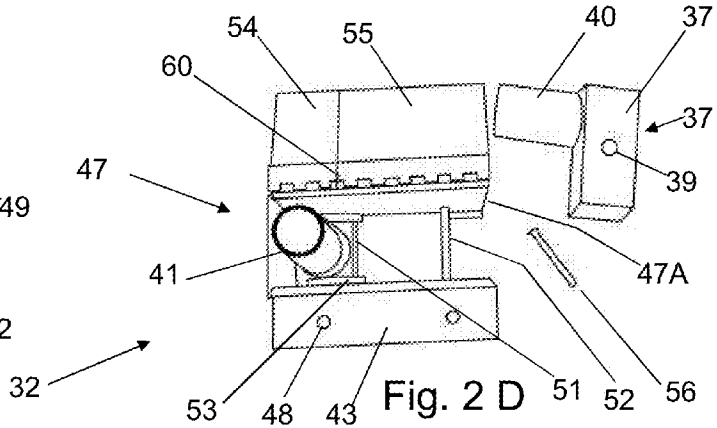
Fig. 2 D
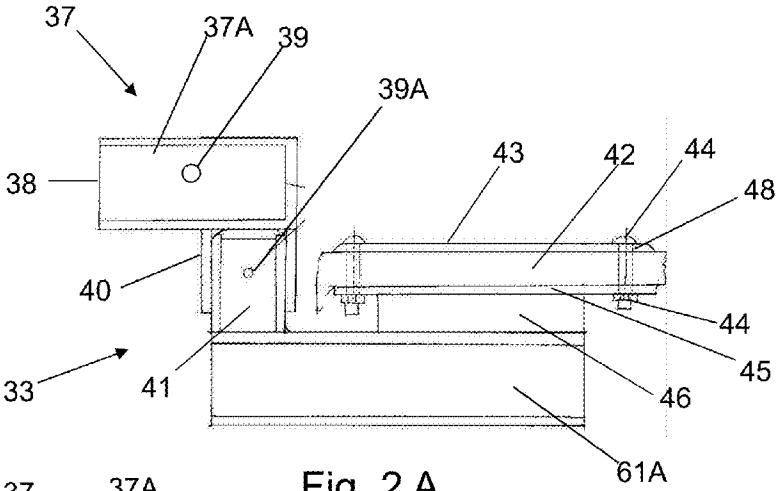
Fig. 2 A
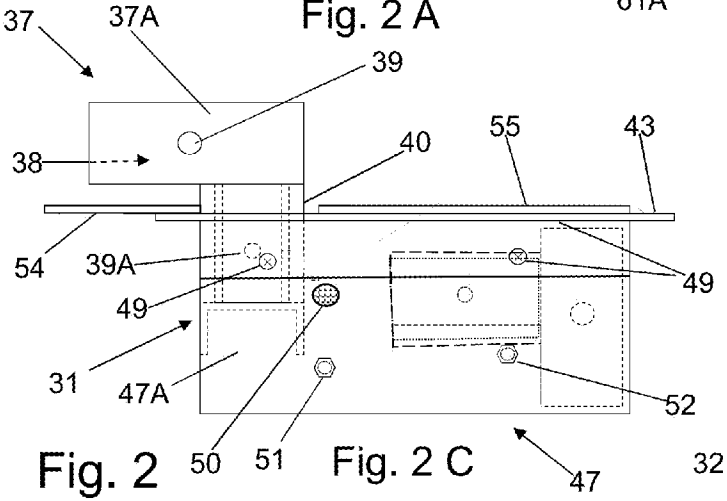
Fig. 2 C
Fig. 2

37A
37
40
52
51
43
49
50
47A 43
48
52
47A
51
53
41

37
39
37A
40
56
41
55
53
54
43
48
47A
47

37
37A
40
55
51
53
54
47
47A
41

37A
38
43
47A
37
55
54

55
37A
43
54
37

37A
40
41
47A
37
47
54

40
43
37A
53
77
38
41
55
54

37
37A
40
41
47A
55
54
47

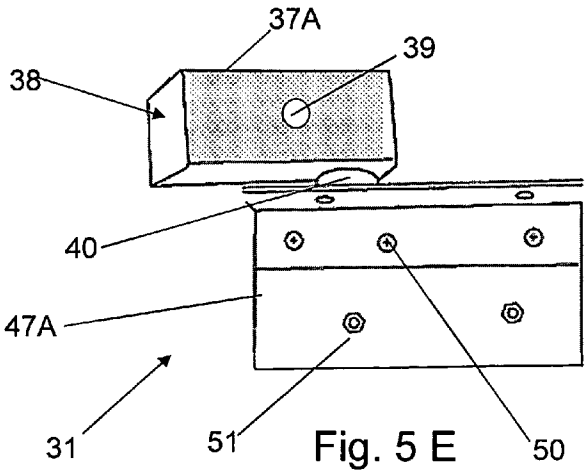
Fig. 5 E
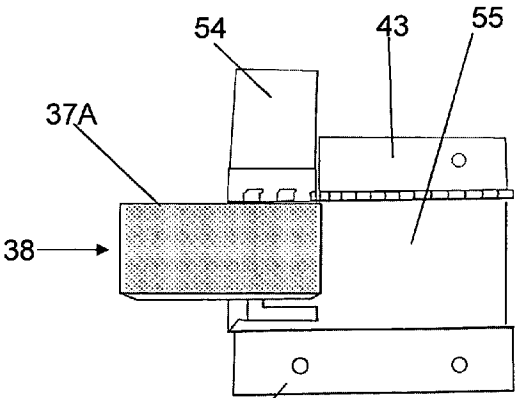
Fig. 5 D
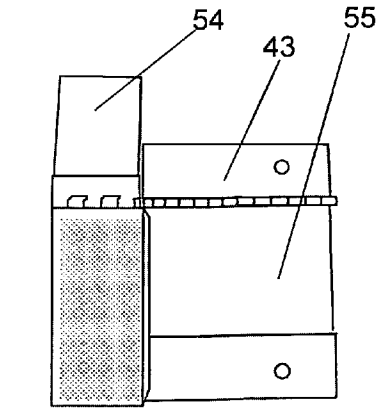
Fig. 5 C
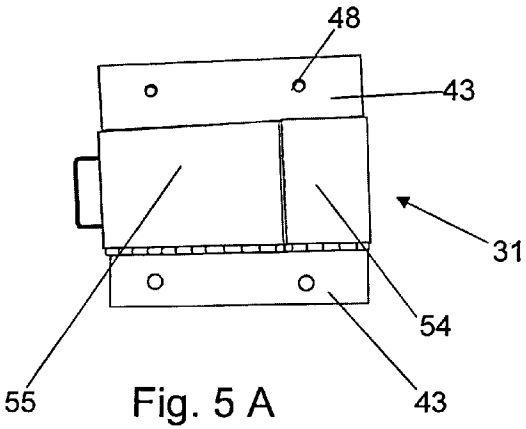
Fig. 5 A
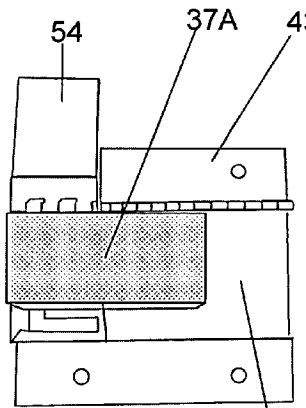
Fig. 5 B
Fig. 5

37
37A
39
39A
38
40
33
41
43
42
44
48
44
45
46
61A

Repeat of 2 A
37A
39
38
37
41
39A
40
63
64
44
64
42
62

40
44
42
37A
53
61A
61

44

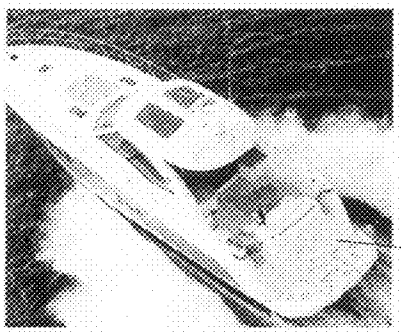
Fig. 7 A
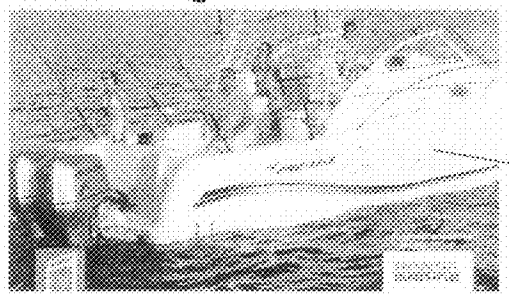
Fig. 7 C
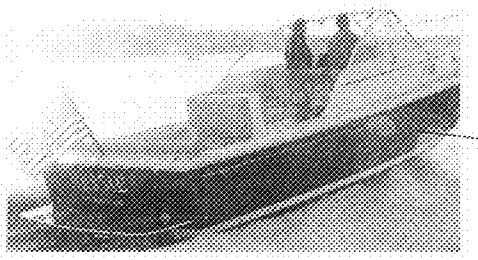
Fig. 7 E
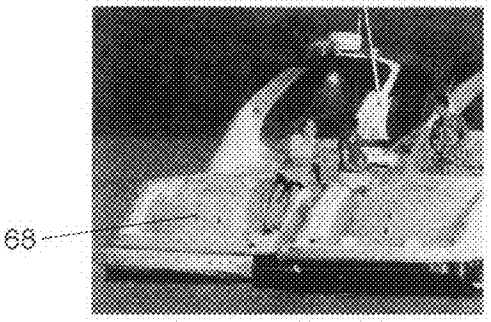
Fig. 7 B
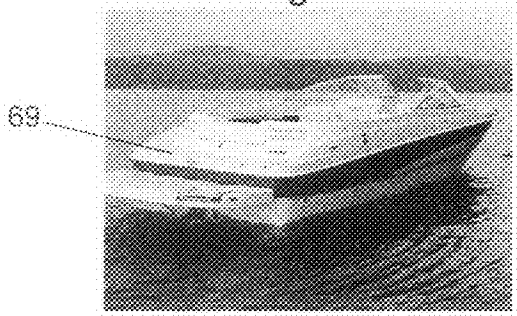
Fig. 7 D
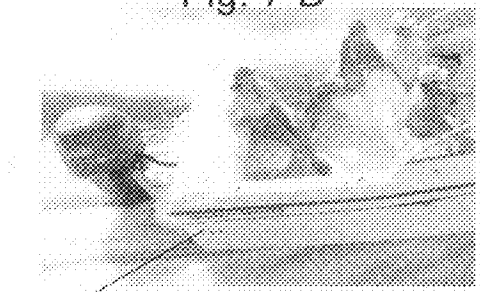
Fig. 7 F
Fig. 7

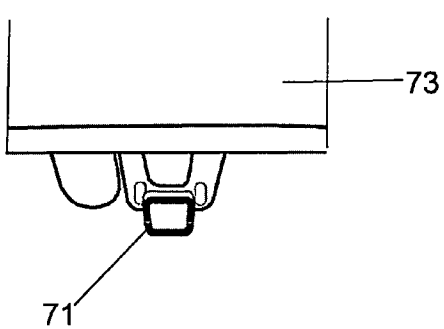
Fig. 8 A
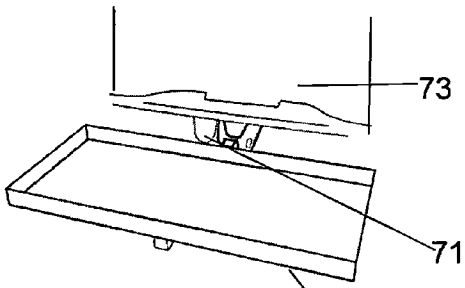
Fig. 8 B
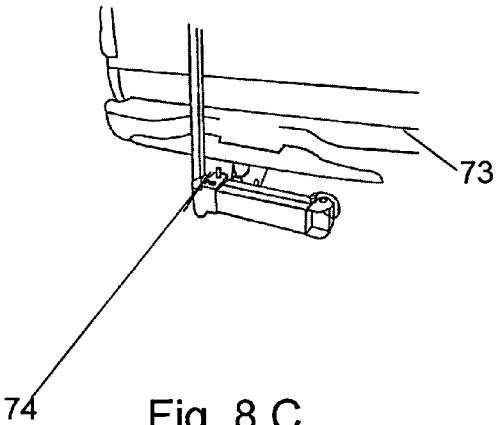
Fig. 8 C
Fig. 8 D
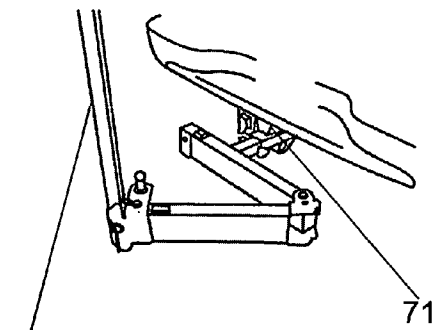
Fig. 8 E
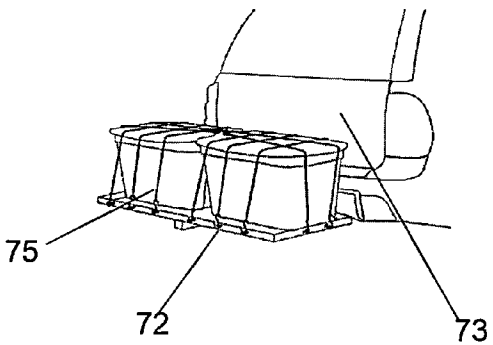
Fig. 8 F
Fig. 8

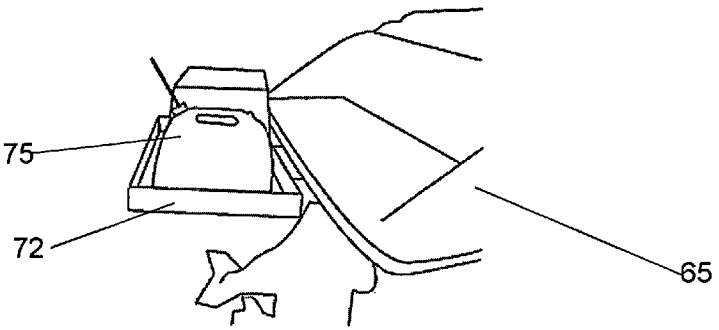
Fig. 9 B
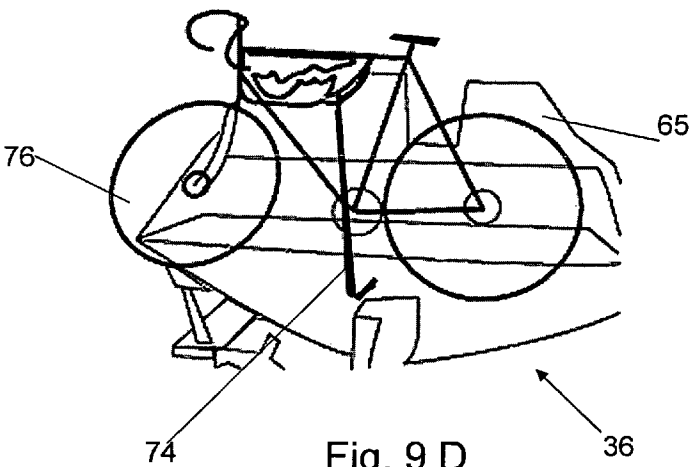
Fig. 9 D
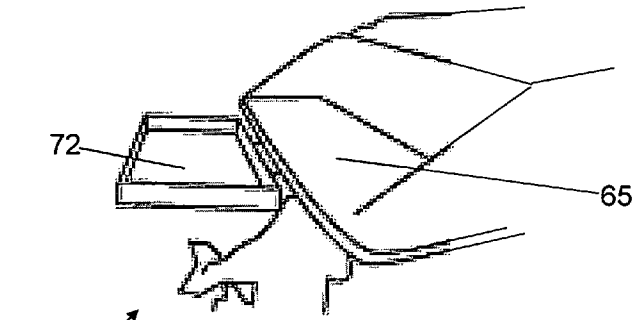
Fig. 9 A
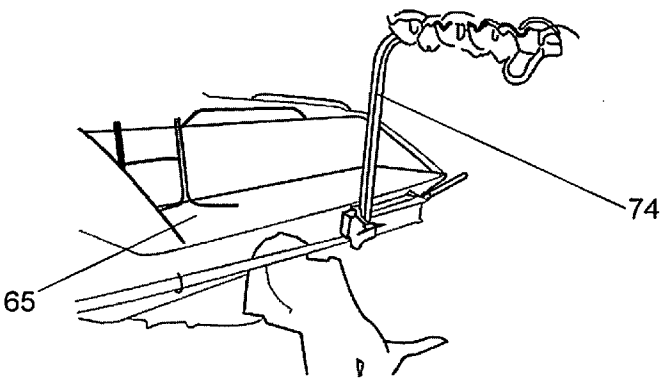
Fig. 9 C
Fig. 9

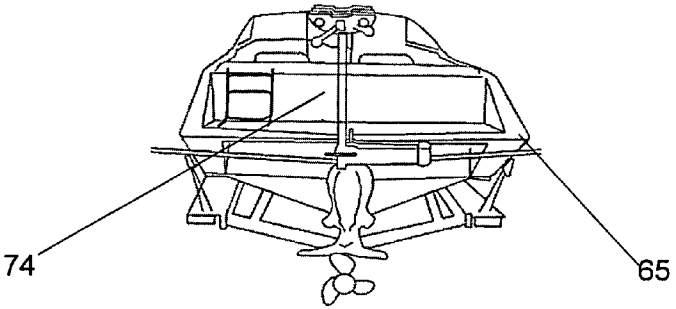
Fig. 10 B
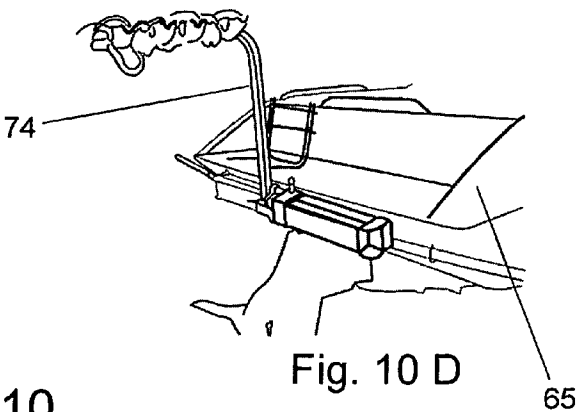
Fig. 10 D
Fig. 10
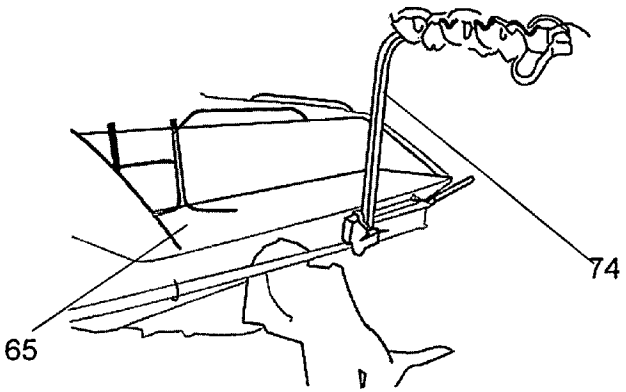
Fig. 10 A
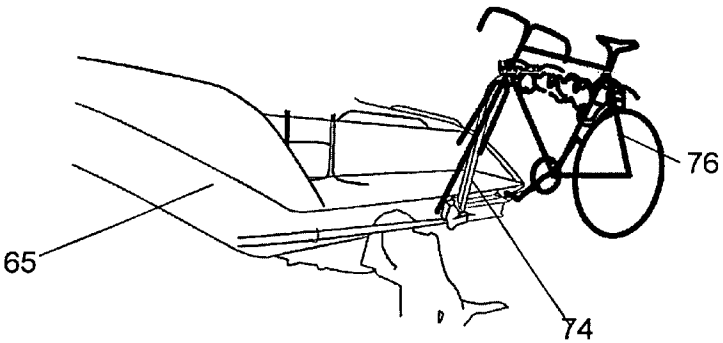
Fig. 10 C

BOAT AND GARAGE HITCHING DEVICE AND CARRYING/STORING SYSTEM

CROSS-REFERENCE TO RELATED APPLICATIONS

This application claims the benefit of Provisional Patent Application Ser. No. 60/814,173 filed Jun. 16, 2006 by Ronald Smith and Mark A. Noffsinger, and titled "BOAT AND GARAGE HITCHING DEVICE AND CARRYING/STORING SYSTEM".

FIELD OF INVENTION

This invention relates to a special hitching and carrying system in a specific new use for boats and other non-wheeled applications. Particularly this new BOAT HITCHING DEVICE is related to devices and methods to carry cargo and the like with any boat, usually in and around diving deck of the boat. Cargo can be of various types since the hitch device has a universal receiver to accept many and varied accessory products such as a storage shelf, an articulated arm and other useful accessories. This BOAT HITCHING DEVICE AND CARRYING SYSTEM may be featured with the original equipment as a manner to carry the various accessories or as an after market enhancement to add features and capability for "hitching" to existing boats that are already in service.

FEDERALLY SPONSORED RESEARCH

None.

SEQUENCE LISTING OR PROGRAM

None.

BACKGROUND

Field of Invention

The new BOAT HITCHING DEVICE AND CARRYING SYSTEM in this specification is a product and system that is designed to provide a special hitching and carrying system as a specific new use for boats and other non-wheeled applications. Particularly this new BOAT HITCHING DEVICE is related to devices and methods to carry cargo and the like with any boat, usually in and around diving deck of the boat. Cargo can now be of various types since the hitch device has a universal receiver to accept accessory products such as a storage shelf, an articulated arm and other useful accessories.

A. Introduction of the Problems Addressed

The storage capacity of boats and other vehicles is limited due to the engine and passenger spaces and their respective configurations. Many boats are configured with platforms along their aft to use for recreation (diving, tubing and swimming) or for fishing. Other uses for storage or transport of cargo has been limited. Historically, storage was completed by bring bicycles and other objects into the passenger area or by make-shift lashing or tying the cargo to the boat.

B. Prior Art

In recent years, some devices and aids to carrying methods have been offered by various means. Examples of prior boat shelf and rack devices begin with U.S. Pat. No. 3,805,722 issued to Melchert, Jr., et al. (1974). This teaches a flip-up rack that is for supporting a fish net rearwardly from the back or stern of a fishing boat, whereby the contents of the fish net may be sorted and brought aboard the fishing boat. The rack includes a horizontal rectangular frame connected with the stern of the boat along the forward edge portion of the frame, said frame being maintained in a horizontal position by a pair of longitudinally extending struts. In one embodiment adapted for an inboard type fishing boat, the frame includes a pair of intermediate bars connected with and extending between the forward and rearward edge portions of the frame. The claims and specification fail to show a universally adapted receiver and hitch as taught by the BOAT HITCHING DEVICE AND CARRYING SYSTEM. Another very specific rack device for boats was issued to Simmonds as U.S. Pat. No. 3,925,836 (1975). It teaches a pair of upright support standards that are provided for mounting from opposite side portions of a boat transom with the lower ends of the standards disposed immediately rearward of the transom. The device is specific and non-adaptable for other storage or carrying methods.

A U.S. Pat. No. 5,439,152 issued to Campbell (1995) teaches a rack device adaptable for trucks and other open bed vehicles. It shows some telescope features but fails to mention or contemplate boats or the like for a universal rack system. Other examples of rack or storage devices include a U.S. Pat. No. 5,454,342 issued to Colquett, et al (1995) which teaches a device for carrying equipment in the rear of a boat adjacent to an outboard motor that comprises a tubular frame of a rigid material, the frame having an upper rectangular component and a lower rectangular component, the rectangular components being disposed in spaced horizontal planes with parallel long sides and parallel short sides. The device is a simple open box-like receptacle without features to accept various storage or carrying accessories as taught by the BOAT HITCHING DEVICE AND CARRYING SYSTEM application herein.

A Hitch assembly apparatus was shown in U.S. Pat. No. 5,673,507 issued to Stokes, Jr. (1997). This device shows a very specific apparatus for mounting trolling devices on a watercraft. It is a support apparatus for use on a watercraft to hold several trolling devices such as outriggers, downriggers, and fishing rods includes oppositely disposed base members and a bridge structure including opposite vertical portions each attached to and extending upward from a corresponding one of the base members, and a horizontally extending portion integral with upper end zones of the vertical portions. The opposite base members removably mount to the watercraft to support the bridge structure above the watercraft's stern. Mounting structures are provided on the base members and bridge structure for holding the trolling devices in operative positions thereon. A hitch assembly for a boat is taught in U.S. Pat. No. 5,893,575 issued to Larkin (1999). It taught a very specific and limited hitch assembly that is provided with a hitch mount and a safety chain connector, both of which adjust to provide a hitch assembly which conforms substantially to the contour of the towing vehicle body when the hitch assembly is not in use. The hitch mount is configured for retractable extension from a hitch base plate, providing a seat for a matching trailer mount. The safety chain connector is configured to selectively provide a seat for a trailer-connected safety chain.

A Scuba gear rack for watercraft was shown and taught by the U.S. Pat. No. 5,901,890 issued to Stokes, Jr. (1999). The patent taught a support rack for use on a watercraft to hold several scuba gear and other equipment such as dive tanks, lights, radar, spear guns and a dive flag, the rack including oppositely disposed base members and a bridge structure including opposite vertical portions each attached to and extending upward from a corresponding one of the base members, and a horizontally extending portion integral with upper end zones of the vertical portions. No universality or adaptability is shown for this very specific, complex device. A U.S. Pat. No. 6,554,170 issued to Correll, et al (2003) was focused on a Boat accessory rack. It included a boat accessory rack that provides a first support, a second support, a cross-bar connecting the first support to the second support, and a plurality of fasteners, which connect the first support and second support to a boat hull. In this manner, a boat owner may quickly and easily install the boat accessory rack on boats embodying a number of different sizes and designs. This does not show the tubular equivalents and adaptability of the BOAT HITCHING DEVICE AND CARRYING SYSTEM.

A rigorous and complex trailer hitch used with pick-up trucks and the like for "fifth wheel" towing is shown in the U.S. Pat. No. 6,846,000 issued to Grinde et al (2005). The patent taught a complex method to mount and pull trailers and the like but is very complex and expensive when compared to the BOAT HITCHING DEVICE AND CARRYING SYSTEM. Another improved fifth wheel hitch for attaching a trailer to a towing vehicle is shown in U.S. Pat. No. 6,935,650 issued again to Grinde, et al. (2005). The hitch includes an outer box support frame having two rails for mounting the trailer hitch to the towing vehicle, a spherical bearing mounted in the frame having a ball joint, and a latch assembly affixed to the spherical bearing to allow the assembly to have two degrees of movement, and a head body. Like the other Grinde device, this is far more complex and costly when compared to the present invention for boat hitch devices and systems.

As far as known, there are no other boat hitching devices or systems at the present time which fully meet this need with as few of components and superior operation as the present BOAT HITCHING DEVICE AND CARRYING SYSTEM. It is believed that this device is made with few parts, of a durable design, and with little expense as compared to wheeled vehicular hitch devices and systems.

SUMMARY OF THE INVENTION

A BOAT HITCHING DEVICE has been developed for use by a person to connect various accessories to a boat and to provide a system to carry and store various cargo. The device is useful with boats including, but not limited to, various boats (especially powered with inboard and outboard motors). It is important to note that many variations of boats may use this device. Most of these boats have a diving or flat surface at the aft or rear of the boat where the device may be placed for use with the carrying system. Specifically, the BOAT HITCHING DEVICE AND CARRYING SYSTEM provides an economical, efficient and easy way to expand useable space on the boating vessel. On a boat with limited space for storage or carrying cargo, this system affords expanded capability to the boat user.

The preferred embodiment of the device is comprised essentially of two main parts: The first part is a case which feature a means to fasten the device to the boat; a means to rotate the receptor from a stored position and then securely retain the receptor in a "use" position (essentially horizontal to the boat deck); a means to pivotally yet securely retain the receptor in the use position; and features and a means to provide a safe and flat deck whether the device is being used or is in storage. The second part is a receptor with a means or hub to pivotally yet securely connect to the case; a receiver tube or structure to receive the various carrying accessories; and a means to securely retain the accessories. These members are potentially made of various materials and are designed for Original Equipment offerings on boats or as After Market additions to boats already in service. The device may have alternative embodiments described below.

The newly invented BOAT HITCHING DEVICE features very few parts. In operation, the new device may be easily and quickly affixed to boats with simple hand tools.

Objects and Advantages

There are several objects and advantages of the BOAT HITCHING DEVICE AND CARRYING SYSTEM. There are currently no known boat hitching devices that are effective at providing the objects of this invention.

The following TABLE A summarizes various advantages and objects of the BOAT HITCHING DEVICE AND CARRYING SYSTEM. This list is exemplary and not limiting to the many advantages offered by this new device.

TABLE A

Various Advantages and Objects

| Item | Description of Advantage and Object |
|---|---|
| 1 | Easy install, uninstall of various racks/accessories |
| 2 | Doesn't use any existing space |
| 3 | Increases security (if locks are used) |
| 4 | Improves boat organization |
| 5 | Increases boat space capacity |
| 6 | Increases boat utility |
| 7 | Can be used with existing vehicle hitch racks and/or custom racks |
| 8 | Clamp on or bolt on or bolt on receiver |
| 9 | Light weight |
| 10 | Use the wall version to store racks when not in use |
| 11 | Receiver is not conspicuous when racks are not being used |
| 12 | Affordable |
| 13 | Simple |
| 14 | Used with any size boat |
| 15 | Corrosion resistant |
| 16 | Various racks and accessories are transferable from car to boat, boat to boat, wall to car to boat, etc. |
| 17 | Multi purpose |
| 18 | Enhances safety - items not strapped to boat rails, or laying around in the cabin, not blocking vision |
| 19 | Keeps boat clean |
| 20 | Helps prevent damage to boat |
| 21 | Maintains interior space for passengers |
| 22 | Grill can be used without dripping grease on the deck, greatly reduced fire hazard |

Finally, other advantages and additional features of the present BOAT HITCHING DEVICE will be more apparent from the accompanying drawings and from the full description of the device. For one skilled in the art of devices and improvements for hitching and carrying cargo, it is readily understood that the features shown in the examples with this mechanism are readily adapted for improvement to other types of hitching and carrying systems.

DESCRIPTION OF THE DRAWINGS

Figures

The accompanying drawings, which are incorporated in and constitute a part of this specification, illustrate a preferred and alternative embodiments for the BOAT HITCHING DEVICE and STORAGE SYSTEM. The drawings together with the summary description given above and a detailed description given below serve to explain the principles of the Special BOAT HITCHING DEVICE. It is understood, however, that the device is not limited to only the precise arrangements and instrumentalities shown.

FIGS. 2A through 2D are sketches of the BOAT HITCHING DEVICE prototypes samples with the various components and features noted.

FIGS. 5A through 5E show sketches of the BOAT HITCHING DEVICE prototype as it is prepared for use.

FIGS. 7A through 7F are sketches that show a few types of power boats that may use the BOAT HITCHING DEVICE AND CARRYING SYSTEM.

FIGS. 8A through 8F are sketches that show another type of carrying and hitch system on a motorized/wheeled vehicle used on land.

FIGS. 9A through 9D are sketches that show the BOAT HITCHING DEVICE AND CARRYING SYSTEM used to store various cargoes.

FIGS. 10A through 10D are sketches that show a use of the BOAT HITCHING DEVICE AND CARRYING SYSTEM portraying an articulated arm with the hitch device.

DESCRIPTION OF THE DRAWINGS

Reference Numerals

Figures 1, 1A, 1B, 1C, 1D, 1E, 1F:
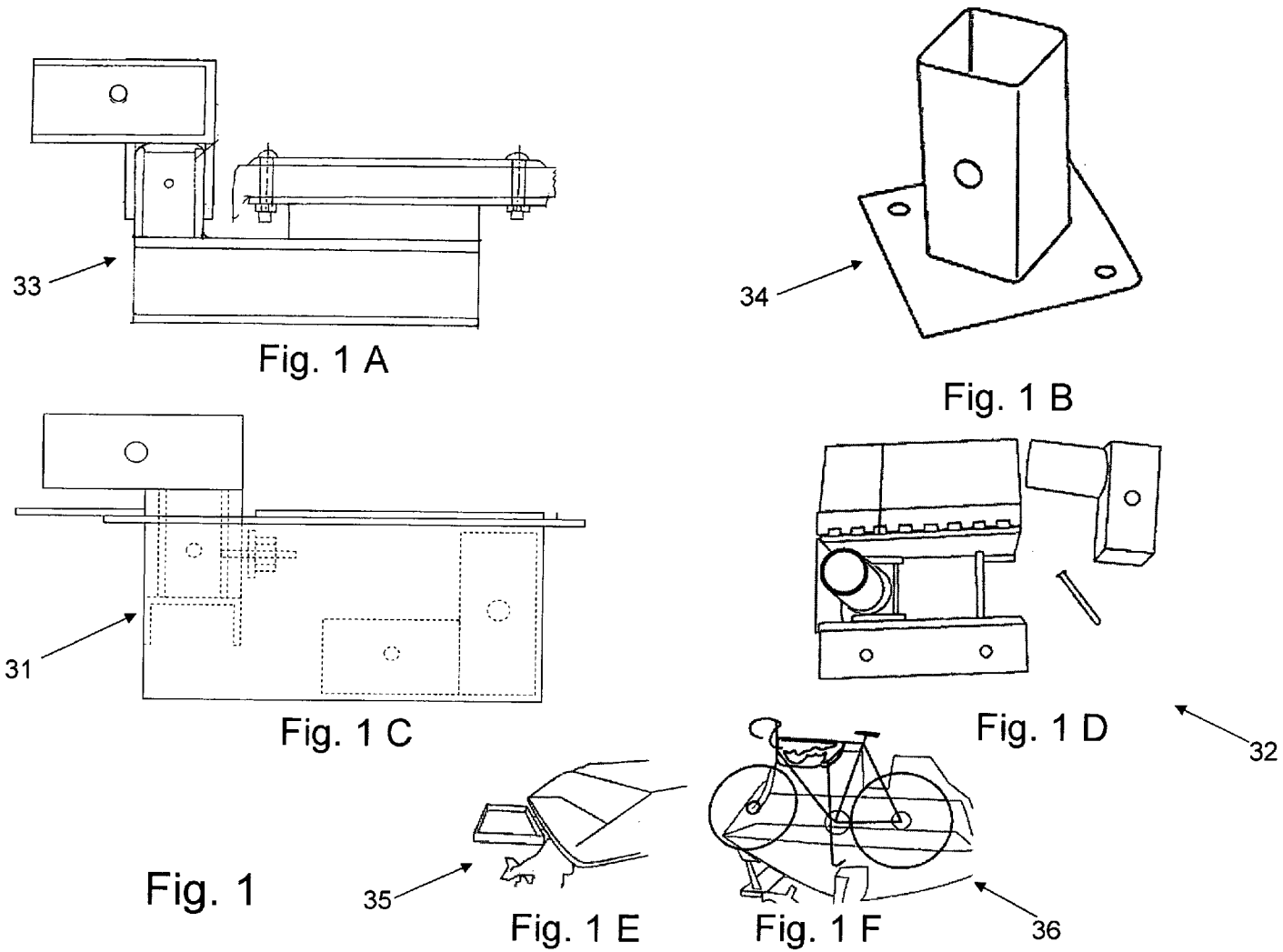
FIGS. 1A through F are sketches of the BOAT HITCHING DEVICE prototypes samples, some of the components for the device, and some general uses for the device.

The following list refers to the drawings:

| Ref # | Description |
|---|---|
| 31 | Prototype of a general BOAT HITCHING DEVICE |
| 32 | Prototype of a general rotatable BOAT HITCHING DEVICE |
| 33 | Sketch of the general fixed BOAT HITCHING DEVICE |
| 34 | Fixed surface receiver - wall or vertical surface |
| 35 | Use of BOAT HITCHING DEVICE AND CARRYING SYSTEM with a removable platform |
| 36 | Use of BOAT HITCHING DEVICE AND CARRYING SYSTEM with an articulating arm |
| 37 | Receptor Assembly |
| 37A | Receiver tube |
| 38 | Aperture of receiving tube (37) |
| 39 | Aperture for hitch pin |
| 39A | Aperture for locator pin |
| 40 | Receiver tube swivel means - hub of receptor assembly 37 |
| 41 | Pivot base for support to receiver tube (40) |
| 42 | Deck of boat |
| 43 | Mounting flange for BOAT HITCHING DEVICE |
| 44 | Fastener |

Reference Numbers—Continued

| Ref # | Description |
|---|---|
| 45 | Mounting plate |
| 46 | Spacer |
| 47 | Case assembly |
| 47A | Case of the BOAT HITCHING DEVICE |
| 48 | Aperture in flange (43) for the BOAT HITCHING DEVICE |
| 49 | Means to connect flange (43) to case (47) |
| 50 | Means to retain (detent) pivot base (41) in a vertical position |
| 51 | Pivot pin |
| 52 | Case connector and device support when retracted |
| 53 | Pivot hinge |
| 54 | Pivot cover |
| 55 | Case cover |
| 56 | Swivel lock pin |
| 57 | Fixed receiver |
| 58 | Mounting flange |
| 59 | Flange mounting aperture |
| 60 | Means to hinge covers (54 and 55) |
| 61 | Alternative embodiment for under deck attachment |
| 61A | Under deck support member |
| 62 | Alternative embodiment for slotted plate attachment |
| 63 | Slide base |
| 64 | Slide receiver |
| 65 | Cruiser with dive platform |
| 66 | Boat with outboard motor and platform |
| 67 | Boat with inboard motor and platform |
| 68 | Two boats with dive platforms |
| 69 | High performance boat with dive platform |
| 70 | General boat with outboard motor and platform |
| 71 | Vehicle receiver |
| 72 | Vehicle shelf |
| 73 | Vehicle |
| 74 | Articulated arm system |
| 75 | Cargo |
| 76 | Bicycles |
| 77 | Means to connect such as welding or the like |

DETAILED DESCRIPTION OF PREFERRED EMBODIMENT

The present mechanism is BOAT HITCHING DEVICE that has been developed for use by a person to connect various accessories to a boat and to provide a system to carry and store various cargo. The preferred embodiment of the device 31 is comprised essentially of two main parts: The first part is a case 47 which feature a means to fasten the device to the boat; a means to rotate the receptor from a stored position and then securely retain the receptor in a "use" position (essentially horizontal to the boat deck); a means to pivotally yet securely retain the receptor in the use position; and features and a means to provide a safe and flat deck whether the device is being used or is in storage. The second part is a receptor 37 with a means or hub to pivotally yet securely connect to the case; a receiver tube or structure to receive the various carrying accessories; and a means to securely retain the accessories. These members are potentially made of various materials. The device may have alternative embodiments described below.

The improvement over the existing art is providing a device that:

Is Easy install and uninstall of various carrying racks/accessories; doesn't use any existing space; increases security (if locks are used); improves boat organization; increases boat space capacity; increases boat utility; can be used with existing vehicle hitch racks and/or custom racks; is able to clamp on or bolt on to deck; is light weight; may use the wall version to store racks when not in use; does not have a receiver that is conspicuous when racks are not being used; is affordable; is simple; may be used with any size boat; is corrosion resistant; afford the use where various racks and accessories are transferable from car to boat, boat to boat, wall to car to boat, etc.; is Multi purposed; enhances safety since items are not strapped to boat rails, laying around in the cabin, and not blocking vision; helps to keeps the boat clean; helps to prevent damage to the boat; maintains interior space for passengers; and keeps a cooking/barbeque grill from dripping grease on the deck which greatly reduces fire hazard.

There is shown in FIGS. 1-10 a complete operative embodiment of the BOAT HITCHING DEVICE 31. In the drawings and illustrations, one notes well that the FIGS. 1-10 demonstrate the general configuration and use of this invention. The preferred embodiment of the device is comprised of only a few parts as shown in the sketches and drawings. The preferred embodiment of the device is comprised essentially of two main part: The first part is a case assembly 47 which feature a means to fasten 43 and 44 the device to the boat deck 42; a means to pivot or rotate 41 and the receptor assembly 37 from a stored position and then a means 50 securely retain the receptor assembly 37 in a "use" position (i.e. receptor assembly 37 is rotated/pivoted and secured essentially horizontal to the boat deck 42); a means to pivotally 51 yet securely retain the receptor assembly 37 in the use position; and features 54, 55, and 60 and a means to provide a safe and flat deck whether the device is being used or is in storage. The second part is a receptor assembly 37 with a means or hub 40 to pivotally yet securely connect to the case; a receiver tube 37A or structure to receive the various carrying accessories; and a means 39 and 56 to securely retain the accessories. The device 31 may have alternative embodiments described below. Various important features of these components are delineated in FIGS. 1-10 of the sketches and drawings and are described below. The description is in appropriate detail for one skilled in the art to appreciate their importance and functionality to the BOAT HITCHING DEVICE 31.

The accompanying drawings, which are incorporated in and constitute a part of this specification, illustrate an embodiment of the BOAT HITCHING DEVICE AND CARRYING SYSTEM 31 that is preferred. The drawings together with the summary description given above and a detailed description given below serve to explain the principles of the BOAT HITCHING DEVICE 31 AND CARRYING SYSTEMS. It is understood, however, that the BOAT HITCHING DEVICE 31 is not limited to only the precise arrangements and instrumentalities shown. This is exemplified with the described alternative embodiments.

FIGS. 1A through F are sketches of the BOAT HITCHING DEVICE 31 prototypes samples, some of the components for the device, and some general uses for the device. FIG. 1A is a side view drawing 33 of the BOAT HITCHING DEVICE 31. FIG. 1B is a sketch of the fixed surface receiver 34. In FIG. 1C, a sketch of a prototype of the general BOAT HITCHING DEVICE 31 is displayed. FIG. 1D shows a sketch of a disassembled prototype BOAT HITCHING DEVICE 31 with components 32. In both FIG. 1E and again in 1F, sketches are of a BOAT HITCHING DEVICE 31 that is shown in use. FIG. 1E shows a removable platform and FIG. 1F shows a hitch system with an articulated arm 36. These uses are detailed further in the OPERATION Section, below.

FIGS. 2A through 2D are sketches of the various BOAT HITCHING DEVICE prototypes samples 31, 32, and 33. In these figures, additional components are shown. FIG. 2A is a side view drawing 33 of the BOAT HITCHING DEVICE 31. The support member 61A is one of the two main parts comprising the BOAT HITCHING DEVICE 31. The member 61A is fastened securely to a pivot base 41. The structure 61A includes a spacer 46 and a mounting plate 45 which may be placed under the deck and connected by fasteners 44. The fasteners 44 are used to securely connect the case assembly 47 directly to the deck 42. This plate 45 "spreads" the overall load of the BOAT HITCHING DEVICE 31 and transfers mounting forces to a larger surface of the deck 42.

The second main part in FIG. 2 A comprising the BOAT HITCHING DEVICE 31 is the receptor assembly 37. Here the receptor assembly 37 has a means or hub 40 to pivotally yet securely connect the assembly 37 to the above described case assembly 47. The hub 40 of receptor assembly 37 is securely and rigidly attached to a receiver tube 37A or structure to receive the various carrying accessories. Integral to the receiver tube 37A is an aperture 39 which may receive a hitch pin 56 once the accessory device (not shown) is placed into the receiver tube 37A. The accessory is placed interiorly into the open aperture 38 of the receiver tube 37A.

One skilled in the art of hitching and carrying devices appreciates that these assemblies 37 and 47 may be made of various materials. Often, assemblies are combinations of materials to keep the designs simple and to lower the costs. Various metals, plastics and composite materials may be used for the main structures. These would include the various types of metals and steels, including, but not limited to stainless steel. The tubes and formed structures may be of various configurations without altering the scope and spirit of this invention. However, to maintain some universality to the plethora of possible mating accessories, a configuration such as a square tube for the receiver 37A is preferred. Likewise the pins, pivot pins and other connections and fastening devices anticipate that a plethora of types of materials and fastening means are well within the scope and spirit of the BOAT HITCHING DEVICE 31.

One skilled in the art of hitching and carrying devices also appreciates that depending on the materials, these assemblies 37 and 47 may be integrally formed into the many proper configuration including thermo-molded (plastics and composites), cast (poured metals) or formed and joined (sheet metals and combinations of metals and plastics). The method to join is again dependent on the materials used. Several fasteners may be used, welding of materials and other means are within the scope of the various processes that may be used to manufacture the BOAT HITCHING DEVICE 31. Finally, various surface preparations and coatings such as plating, painting, and powder coating may be desired to eliminate or minimize corrosion often accompanying boating devices used around water.

Next, in FIG. 2B is a sketch of the fixed surface receiver 34. This prototype shows the fixed receiver 57 mounted securely to a base plate 58. The base plate 58 has apertures 59 in order to mount the flat surface receiver 34 to a wall, floor or other flat structure. The receiver tube 57 also features an aperture 39 to receive a hitch pin 56 (not shown) and the opening 38 to receive the accessory. The flat surface receiver 34 may be mounted in a garage, boat house, or other location to store the carrier devices up and out of the way when not used with the boat. They may also be used on their own for special storage of the device, with or without cargo. Finally, they may be used to organize and store any materials that can fit and adapt to the square tube receiver. As to materials, fastening and coatings, etc. the flat surface adapter 34 would consist of similar materials used with the components described above for the BOAT HITCHING DEVICE 31.

In FIG. 2C, a sketch of a prototype of the general BOAT HITCHING DEVICE 31 is displayed. The components are the same as described above for the BOAT HITCHING DEVICE 31 shown in FIG. 2A. A few additional details are shown in this sketch of the prototype. Here, the fastening means 49 is used to attach the flange 43 to the case 47A. Another fastener across and interior to the case 47A is the long connector 52. Further, the pivot pin 51 is shown. This permits the pivot base 41 to rotate and permit the whole receptor assembly 37 to be rotated up from storage and be positioned "vertically" for use as a receiver. In order to "restrain and contain" the receptor assembly 37 from rotating back to storage before a carrier is attached to the tube 37A, a spring activated detention device 50 or the like is placed as shown. Materials for these various components are described above for the BOAT HITCHING DEVICE 31.

FIG. 2D shows a sketch of a disassembled prototype BOAT HITCHING DEVICE 31 with components 32. This is a good view of the two separate assemblies, the case assembly 47 and the receptor assembly 37. Important features shown here are the pivot cover 54 and case cover 55. They are attached to the flange 43 by a hinge means 60. The internal hinge pieces 53 are securely attached to the pivot base 41 (by welding or integral molding or other secure fastening means). Likewise, the through pivot pin 51 (not shown) traverses the case 47A and rotatably connects the hinge 53 to the case 47A. Other features demonstrate the through connector 52 and the hitch pin 56.

Figures 3, 3A, 3B, 3C, 3D:
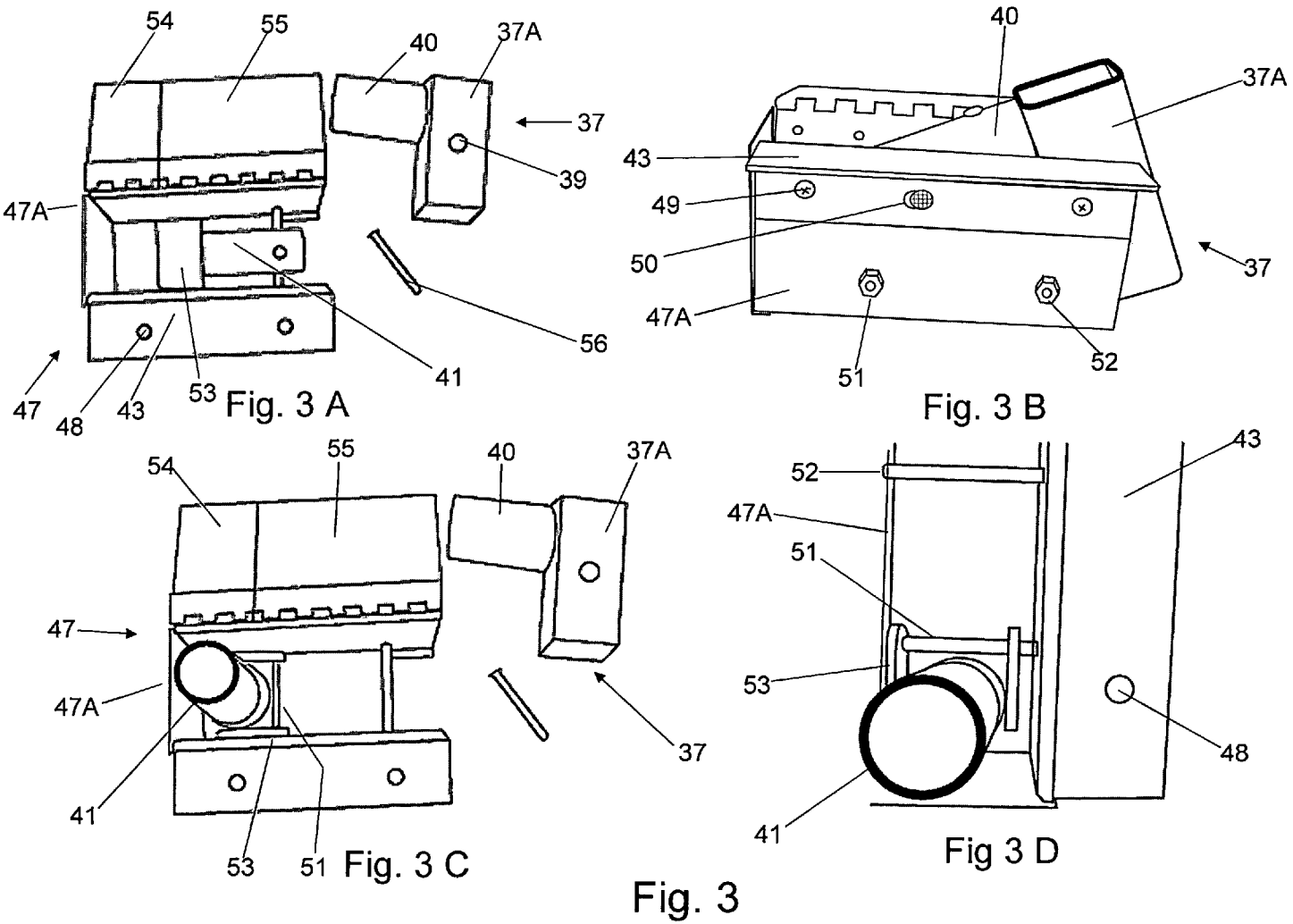
FIG. 3A and 3D are sketches of the BOAT HITCHING DEVICE prototypes samples with the various components and features noted. The sketches also show how the device is prepared for use.
Figures 4, 4A, 4B, 4C, 4D, 4E:
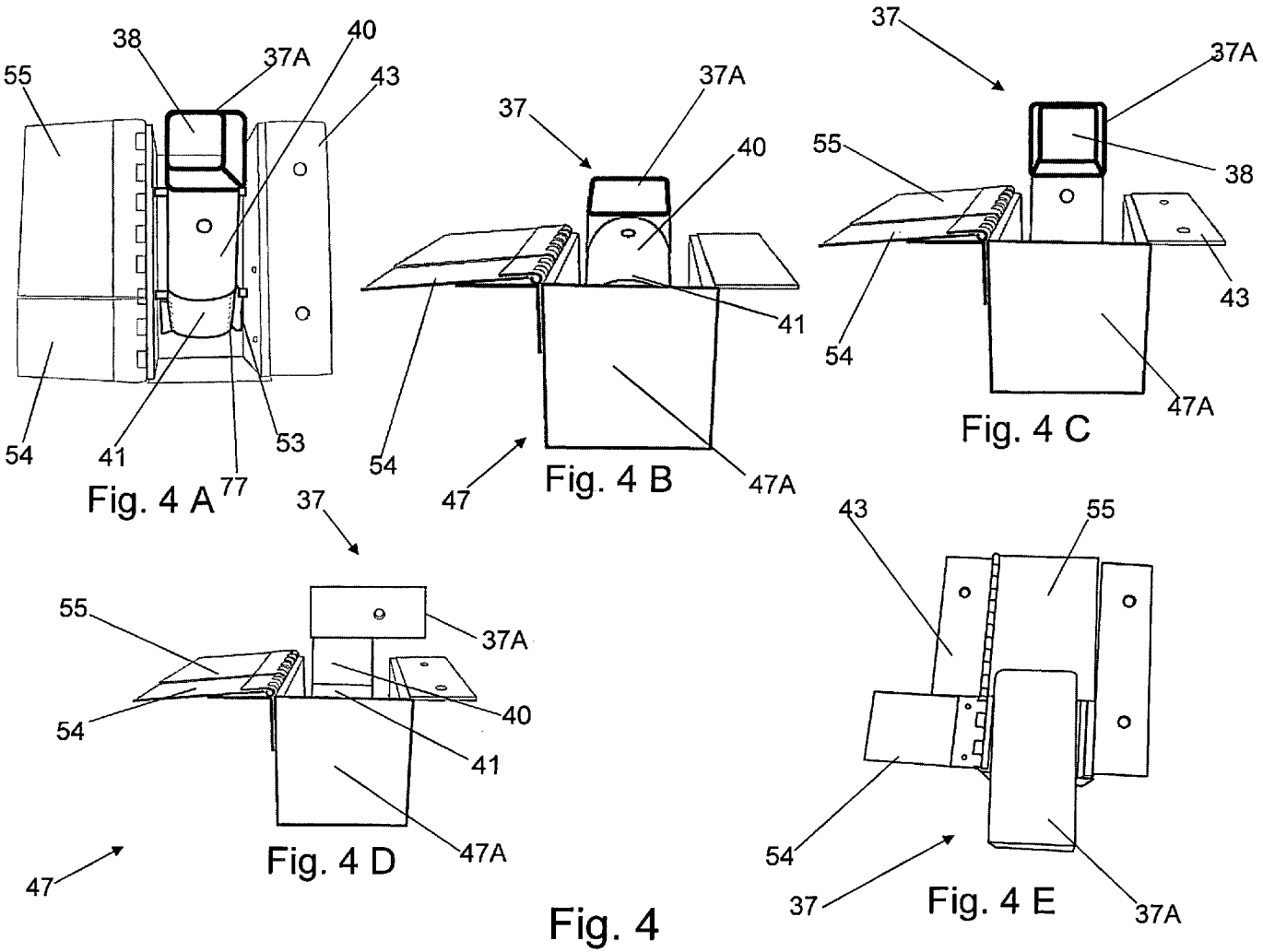
FIGS. 4 including 4A through 4E are additional sketches of the BOAT HITCHING DEVICE prototypes samples with the various components and features noted. These sketches also show how the device is prepared for use.

FIGS. 3, 4 and 5 describe the use and operation of the BOAT HITCHING DEVICE 31 that is preferred and is described in the OPERATIONS section, BELOW.

Figures 6, 6A, 6B, 6C:
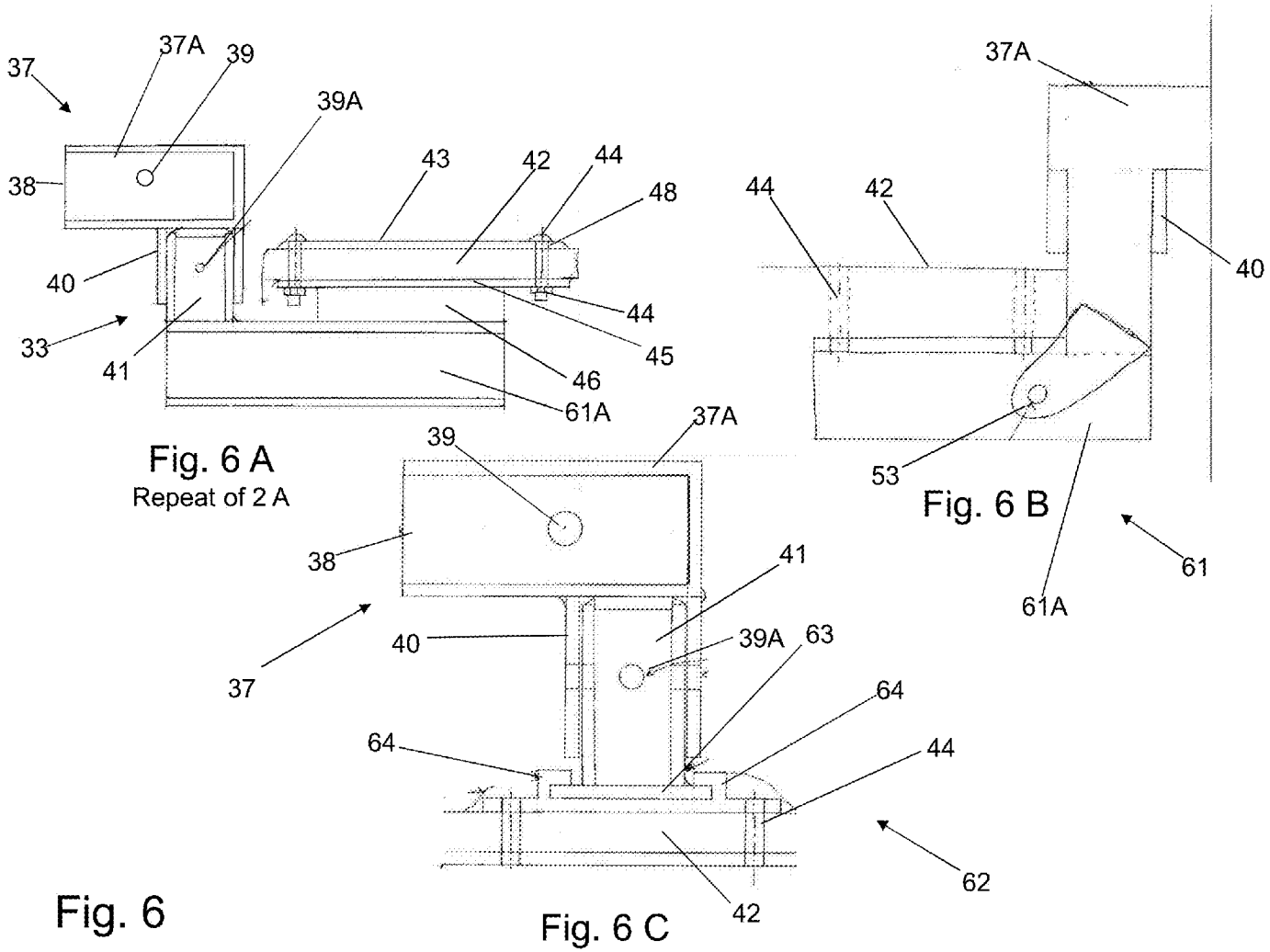
FIGS. 6A through 6C are sketches of the preferred embodiment of the BOAT HITCHING DEVICE and two alternative embodiments.

FIGS. 6A through 6C are sketches of the preferred embodiment of the BOAT HITCHING DEVICE and two alternative embodiments. FIG. 6A is a repeat of FIG. 2A, shown and described above. It is placed here for easy reference to the preferred device of the BOAT HITCHING DEVICE 33 as shown in this FIG. 6A. FIG. 6B is another view of the alternative embodiment. The alternate under deck device 61 anticipates a more fixed and offset configuration. Here the receiver tube 37 is still on a pivot hub 40 of receptor assembly 37. The overall case structure 61A is mounted beneath the deck 42 by fasteners 44. The carrier accessory is still placed from the rear of the boat into the receiver tube 37. In FIG. 6 B, an alternative embodiment for a slider plate mounting 62 is demonstrated. With some similarities to the preferred embodiment 31 with a case assembly 47, this unit is securely mounted to a plate 63. The plate 63 slides and is mounted internally to the slide receiver 64 shown in the side view. The slide receiver 64 is fastened to the deck 42 by means of fasteners 44. The receptor assembly 37 fits over the pivot base 41 by means of the hub 40 of the receptor assembly 37. Locator apertures 39A are used to accept hitch pins 56 (not shown) to secure the device and maintain it overall position in respect to the boat.

FIGS. 7 through 10 are sketches that show a few types of uses and are included in the OPERATION section, below.

All of the details mentioned here are exemplary and not limiting. Other specific components specific to describing a BOAT HITCHING DEVICE 31 may be added as a person having ordinary skill in the field of hitching and carrying devices well appreciates.

Operation of the Preferred Embodiment

The new BOAT HITCHING DEVICE 31 has been described in the above embodiment. The manner of how the device operates is described below. One skilled in the art of hitching devices will note that the description above and the operation described here must be taken together to fully illustrate the concept of the BOAT HITCHING DEVICE 31 and CARRYING SYSTEM. The preferred embodiment described above is essentially comprised of only a few parts as shown in the sketches and drawings. The first part is a case assembly 47 with features and subcomponents described fully, above. The second part is a receptor assembly 37 with additional means and features described above.

FIG. 3A and 3D are sketches of the BOAT HITCHING DEVICE prototypes samples with the various components and features noted. The sketches also show how the device is prepared for use. The configuration and materials of the components are as described above in FIGS. 2A, C, and D. The process is shown as:

- STEP 1: Install Case assembly 47 comprised of a Pivot base 41 and Receptor assembly 37 on the deck of a boat;
- STEP 2: Store Pivot Base 41 in a horizontal position with the Receptor 37 turned down;
- STEP 3: Open cover 55 of case assembly 47;
- STEP 4: Rotate Pivot Base 41 and Receptor 37 from horizontal to vertical;
- STEP 5: Rotate Receptor 37 if desired to proper position and lock with pin 56;
- STEP 6: Close covers 54 to remove opening in case assembly 47;
- STEP 7: Insert accessories into receptor 37 aperture 38 and lock with typical hitch pin;
- STEP 8: Reverse process steps 2 through 7 and store unit; and
- STEP 9: Repeat.

One may note in FIG. 3A that the pivot base 41 is in a horizontal position for storage and non-use. It is attached to the case 47A by the hinge means 53. FIG. 3B shows the case assembly 47 and the receptor assembly 37 in a partially rotated position. In FIGS. 3C, the pivot base 41 is rotated to a full vertical position. Note in this position, the pivot base 41 and the hub 40 of receptor assembly 37 are both essentially vertical. This means the receptor tube 37A is essentially horizontal and could be ready for use once pivoted to the proper angle.

In FIGS. 3 and 4, the BOAT HITCHING DEVICE 31 has the distinct advantage of the rotating component 37 allowing for ease in inserting the carrier into the receiver 37A while "over the boat". This means an operator/user need not lean out over the water to use the device 31. This also affords objects or cargo 75 to be carried over the platform surface while the boat is underway or while the boat is docking. The gives the ability to "swivel" the loaded device out of way for passenger boarding or disembarking. This swivel feature also allows for variety of "dual carrier applications", such as carrying cargo 75 being suspended between the two carriers (such as dingy, kayak, canoe, hammock, etc).

FIGS. 4 including 4A through 4E are additional sketches of the BOAT HITCHING DEVICE prototypes samples with the various components and features noted. Like in FIGS. 3, above, these sketches also show how the device is prepared for use. FIG. 4A is a top view sketch which shows the BOAT HITCHING DEVICE 31 in the storage or non-use position with the pivot cover 54 and the case cover 55 open to show components. The configuration and materials of the components are as described above in FIGS. 2A, C, and D. In FIG. 4B, an end view sketch shows that the receptor assembly 37 is starting to rotate up to vertical inside the case assembly 47. In FIG. 4C, another end view sketch, shows the receptor assembly 37 that is fully vertical but turned opposite from the carrier side of the BOAT HITCHING DEVICE 31 or the aft/rear of the boat. The end view sketch in FIG. 4D shows the receiver 37 pivoted partially toward the rear. Finally, in the top view sketch showed by FIG. 4E, the receiver 37 is pointed correctly toward the rear and ready to receive a carrier accessory. Note the carrier cover 55 is in a safe, closed position and no open compartment is left open.

FIGS. 5A through 5E show top and end view sketches of the BOAT HITCHING DEVICE prototype as it is prepared for use. FIG. 5A is a top view that shows the device in a closed position with both covers 54 and 55 closed. FIG. 5B, C, and D are top view sketches showing the receptor assembly 37 and component receiver 37A being pivoted into a use position. Finally, FIG. 5E is a side view sketch with the receiver tube 37A faced aft/rearward and ready to accept a carrier accessory.

FIGS. 7A through 7F are sketches that show a few types of power boats that may use the BOAT HITCHING DEVICE 31 AND CARRYING SYSTEM. Note the various inboard and outboard designs on the boats 65, 66, 67, 68, 69, and 70. It is noted that most of these boats have rear platforms where the BOAT HITCHING DEVICE 31 may be easily mounted as described above.

FIGS. 8A through 8F are sketches that show another type of carrying and hitch system on a motorized/wheeled vehicle used on land. This operation for wheeled vehicles have some parallels in operation with the new form of use with boats. The new use is made possible by the BOAT HITCHING DEVICE 31 that may be mounted to the deck 42 of the boat. FIG. 8A shows a typical receiver hitch 71 on a wheeled vehicle. It is mounted to the underside frame or bumper of the vehicle. FIGS. 8B through 8F show the vehicles 73 with the hitch receivers 71. Also a simple platform 72 and a sophisticated articulated arm system 74 are shown in the various FIGS. Cargo 75 is shown on a platform 72 in FIG. 8F.

FIGS. 9A through 9D are sketches that show the BOAT HITCHING DEVICE 31 AND CARRYING SYSTEM used to store various cargoes 75. FIG. 9A shows a storage platform 72 attached to the boat 65. FIG. 9B shows the platform 72 with cargo 75. In FIG. 9C, another carrier accessory, called an articulated arm system, 74 is attached to the boat 65 by use of the BOAT HITCHING DEVICE 31. In FIG. 9D the articulated arm system 74 is holding a cargo, here bicycles 76.

FIGS. 10A through 10D are additional sketches that show a use of the BOAT HITCHING DEVICE 31 AND CARRYING SYSTEM portraying an articulated arm 74 with the hitch device. All four FIGS. 9A through 9D show views of the articulated arm system 74 connected to the boat 65 by means of the BOAT HITCHING DEVICE 31

There are many potential uses for this device with the boating industry as described herein. However, these describe uses are exemplary and not intended as a limitation of anticipated uses for the BOAT HITCHING DEVICE 31. The following TABLE B shows additional examples of potential uses.

TABLE B

POSSIBLE NEW USES

| ITEM | DESCRIPTION |
|---|---|
| 1 | Storage or transportation of: grills, bicycles, canoes, coolers, luggage, etc. |
| 2 | Fishing/trolling rig |
| 3 | Fish net rack |
| 4 | Fish cleaning table |
| 5 | Scuba tank rack |
| 6 | Dingy rack |
| 7 | Ski rack/tow rope reel |
| 8 | Hammock |
| 9 | Utility rack |
| 10 | Live well |
| 11 | Support a safety net and/or rail around the back of the deck |

With this description it is to be understood that the BOAT HITCHING DEVICE 31 is not to be limited to only the disclosed embodiment. The features of the BOAT HITCHING DEVICE 31 are intended to cover various modifications and equivalent arrangements included within the spirit and scope of the description.

What is claimed is:

1. A hitching, storing and carrying device for a boat, said device being made of a lightweight, durable material that is corrosion resistant, and said device being mounted beneath a deck (42) of the boat (66) and comprising:

(a) a case assembly (47) comprised of
  (1) a case (47A);
  (2) a case connector (52) that is secured and extends across the full width and interior to the case (47A) and that supports a receptor assembly (37) when the receptor assembly (37) and a pivot base (41) are in an essentially horizontal position;
  (3) a pair of flanges(43) with a pair of apertures (48) for securing the device of the boat;
  (4) a means (49) to connect the flanges (43) to the case (47A);
  (5) a pair of fasteners (44) for securing each of the flanges (43) through the apertures (48) and to the deck of the boat;
  (6) a pivot cover (54);
  (7) a case cover (55);
  (8) a means (60) for securing the pivot and case covers to the flange; and
  (9) a means (50) for retaining the receptor assembly (37) in an essentially vertical position;

(b) the receptor assembly (37) comprised of
  (1) a square receiver tube (37A) with an open aperture/opening (38) and an aperture (39) for a pin (56);
  (2) a hub(40) of the receptor assembly (37); and
  (3) a means for rigidly attaching the hub (40) of the receptor assembly 37 and the square receiver tube (37A);

(c) the pivot base (41) that pivotally supports the receptor assembly (37) at the hub (40) of receptor assembly 37;

(d) a Pivot hinge (53) that is rotatably connected to a pivot pin (51);

(e) a fastening means (77) for securely attaching the internal pivot hinge (53) to the connecting pivot base (41);

(f) the pivot pin (51) being secured across the width and interior to the case (47A) and the pivot pin (51) extending through the pivot hinge (53) whereby the case (47A) and receptor assembly (37) are pivotally secured together; and (g) a combination comprised of the aperture (39) of the square receiver tube (37A) and the pin (56) for securing an accessory in the receiving aperture in an essentially horizontal position relative to the deck whereby the use of the device is to safely secure accessories in the receptor assembly tube for expanding storage and transportation capabilities on the boat; whereby the device may be affixed with simple hand tools; and whereby the device is stored safely under the deck and covered by the pivot and case covers when not being used to carry accessories.

2. The device according to claim 1 wherein the storage and transportation device can hold grills, bicycles, canoes, coolers, luggage, fishing gear, water skiing gear and other cargo associated with water recreation.

* * * * *